United States Patent [19]

Izumi et al.

[11] Patent Number: 4,609,540

[45] Date of Patent: Sep. 2, 1986

[54] PROCESS FOR PRODUCING CARBON FIBERS

[75] Inventors: Jinko Izumi; Yoshitaka Imai; Munetsugu Nakatani; Yoshiteru Tanuku; Naoyuki Fukahori, all of Ohtake, Japan

[73] Assignee: Mitsubishi Rayon Co., Ltd., Tokyo, Japan

[21] Appl. No.: 733,797

[22] Filed: May 14, 1985

[30] Foreign Application Priority Data

May 18, 1984 [JP] Japan ..... 59-99757
May 18, 1984 [JP] Japan ..... 59-99758

[51] Int. Cl.[4] ..... D01F 9/22

[52] U.S. Cl. ..... 423/447.6; 423/447.2; 423/447.4; 264/29.2

[58] Field of Search ..... 423/447.4, 447.6; 264/29.2

[56] References Cited

U.S. PATENT DOCUMENTS

| | | | |
|---|---|---|---|
| 3,632,798 | 1/1972 | Morita et al. | 264/29.2 |
| 3,914,960 | 10/1975 | McGuffin et al. | 423/447.6 |
| 3,972,984 | 8/1976 | Iizuka et al. | 264/29.2 |
| 4,080,417 | 3/1978 | Kishimoto et al. | 264/29.2 |
| 4,100,004 | 7/1978 | Moss et al. | 264/29.2 |
| 4,452,860 | 6/1984 | Obama et al. | 264/29.2 |

FOREIGN PATENT DOCUMENTS

| | | | |
|---|---|---|---|
| 49-127121 | 8/1974 | Japan | 423/447.4 |
| 54-147222 | 11/1979 | Japan | 264/29.2 |
| 59-106522 | 6/1984 | Japan | 264/29.2 |
| 59-137512 | 8/1984 | Japan | 264/29.2 |

*Primary Examiner*—John Doll
*Assistant Examiner*—Robert Kunemund
*Attorney, Agent, or Firm*—Oblon, Fisher, Spivak, McClelland & Maier

[57] ABSTRACT

A process for producing a carbon fiber having a tenacity of 450 kg/mm$^2$ or more, preferably 500 kg/mm$^2$ or more, and a modulus of elasticity of 25 ton/mm$^2$ or more which comprises subjecting a polyacrylonitrile-type fiber to a flame-resisting treatment in a flame-resisting treatment furnace provided with a plural number of driving rolls in an oxidizing atmosphere at 200° to 400° C. under application of multistep elongation, during said treatment the respective percentage of elongation in said multistep elongation being set respectively at a value which is equal to or within ±3% of the value of the percentage of elongation En indicating an inflection point Pn obtainable from the load and the percentage of elongation determined in advance by experimental measurements, and then subjecting the treated fiber to carbonization.

6 Claims, 5 Drawing Figures

PROCESS FOR PRODUCING CARBON FIBERS

TECHNICAL FIELD

This invention relates to a process for producing high-quality and high-performance carbon fibers.

BACKGROUND ART

The production of carbon fibers from acrylic fibers is generally conducted by a process which comprises heat-treating the latter fiber in an oxidizing atmosphere at 200° to 400° C. to form a flame-resistant structure and then carbonizing the resulting fiber in an inert atmosphere at a temperature not lower than 400° C. In the above process, application of tension or elongation during the flame-resisting treatment is effective for producing carbon fibers having excellent tenacity and modulus of elasticity. For example, Japanese Patent Application Kokai (Laid-Open) No. 54,632/74 discloses a process to produce a high-performance carbon fiber by dividing the elongation during the flame-resisting treatment properly into that at the initial stage and that at the latter stage of the treatment.

However, acrylic fibers may sometimes give, depending on their initial molecular orientations or molecular cohesive forces, carbon fibers of more excellent performance when applied a shrinkage in the flame-resisting treatment rather than when applied an elongation. In the above-mentioned process, accordingly, excessive elongation may promote the development of fluff or structural defects. Thus, the optimum percentage of elongation or shrinkage in the flame-resisting treatment varies depending on the kind of precursors and is also influenced by the temperature of the atmosphere. Accordingly, it has been very difficult up to now to optimize the above conditions.

There have also been known a large number of proposals regarding the carbonization step.

For example, there is known a process disclosed in Japanese Patent Application Kokai (Laid-Open) No. 147,222/79. The process comprises subjecting a fiber which has been made flame-resistant and imparted a fiber density of 1.30 to 1.42 g/cm$^3$ to a carbonization treatment in an inert atmosphere at a temperature region of 300° to 800° C. while applying an elongation in the range of 25% or less, and subsequently to a heat treatment at a temperature not lower than 800° C. to obtain a carbon fiber. It is known that when a fiber which has been made flame-resistant is heat-treated under a constant load at a temperature not lower than 300° C., the fiber undergoes a change of fiber length as shown in FIG. 1 in correspondence to the change of its density. In a heat-treatment region wherein the fiber density reaches about 1.50, the fiber itself undergoes a marked physical change and the structure of the fiber undergoes a complicated change. In conventional processes for producing carbon fibers, accordingly, the heat treatment has been conducted under such tension as to cause shrinkage of fiber length in order to prevent the occurring of troubles such as fiber breakage in said heat-treatment region. Such methods have been unable to produce carbon fibers of a high tenacity as described in the above-mentioned patent application, whereas the aforesaid invention has attained the object by the application of an elongation of up to 25% in said region. In said process, however, when a total elongation of up to 25% is applied, an extreme change of fiber length takes place, making uniform elongation treatment impossible.

Therefore, it is very difficult to produce by the process carbon fibers showing uniform and high performance constantly.

As to the temperature-increase gradient, there is known a process disclosed, for example, in Japanese Patent Application Kokai (Laid-Open) No. 214,529/83. The process comprises subjecting a polyacrylonitrile-type fiber which has been made flame-resistant to heat treatment first in an inert atmosphere at 300° to 700° C. at a temperature-increasing rate of 100° to 1100° C./minute, then in an inert atmosphere through a region of 700° C. to 1000° C. at a temperature-increasing rate of 300° to 5,000° C./minute, and further in an inert atmosphere through a region of 1000° to 1200° C. at a temperature-increasing rate of 100° to 1800° C./minute to form a carbon fiber. However, the process involves as yet some points to be improved to become a process which can produce a high-tenacity carbon fiber having a tenacity of 400 kg/mm$^2$ or more, particularly 450 kg/mm$^2$ or more, with a narrow variation of quality and a high carbonization yield while suppressing the development of fluff to the minimum.

The studies on production of high-performance carbon fibers have been pursued from various aspects. It has been revealed that the most important point is to prevent the phenomena of fusion-bonding and agglutination between fibers in the flame-resisting treatment of the precursor. It is said that carbon fiber tow containing fusion-bonded fibers is of extremely low practical value even when the carbon fiber shows a single fiber property of a tenacity of 400 kg/mm$^2$ and an elongation of 1.5% or more.

As to the prevention of fusion bonding and agglutination of the treated fibers in the flame-resisting step, there is disclosed in Japanese Patent Application Kokoku (Post-Exam. Publn) No. 24,136/77 a process to use a silicone-type textile oil as the oil for the precursor. However, the aminosiloxane-type oil disclosed in the above Application is still unsatisfactory for preventing fusion-bonding. This is due to the fact that owing to the fusion-bonding promotion effect of impurities such as emulsifier components contained in the aminosiloxane-type oil and also to the sticking effect of aminosiloxane the precursor is excessively collected, which results in insufficient fiber-separation of the precursor.

OBJECT OF THE INVENTION

An object of this invention is to provide a high-quality and high-performance carbon fiber having few fiber defects due to fusion-bonding between fibers by subjecting a precursor, to which an aminosiloxane-type oil has been attached by impregnation, from which the impurities in the attached oil has been removed by washing, and which has been improved in fiber separation, to a high-degree stretching to attain a high-degree orientation and an increased density, and then subjecting the resulting precursor to a flame-resisting treatment and a heat treatment.

Another object of this invention is to provide a carbon fiber having extremely excellent properties by providing a plural number of driving rolls in the flame-resisting step and setting the percentage of elongation or shrinkage between respective rolls at a value which has been determined beforehand for the fiber at the respective feed-side roll by batchwise experiments.

A further object of this invention is to provide a high-quality and high-performance carbon fiber by carbonizing a flame-resisting-treated fiber of a specified low fiber density under specified conditions at a low temperature and a low temperature-increasing rate, and then subjecting the resulting fiber to a carbonization treatment at high temperatures increasing stepwise.

BRIEF DESCRIPTION OF THE DRAWINGS

A brief description will be given below of the drawings attached to be used for illustrating this invention.

CONSTRUCTION OF THE INVENTION

The essentials of this invention is a process for producing a high-performance carbon fiber which comprises subjecting a polyacrylonitrile-type polymer fiber to a flame-resisting treatment in a flame-resisting treatment furnace provided with a plural number of driving rolls in an oxidizing atmosphere at 200° to 400° C. under application of multistep elongation, during said treatment the respective percentage of elongation in said multistep elongation being set respectively at a value which is equal to or within ±3% of the value of the percentage of elongation $E_n$ indicating an inflection point $P_n$ obtainable from the load and the percentage of elongation determined in advance by experimental measurements, and then subjecting the treated fiber to carbonization, the residence time of said fiber between respective driving rolls in said multistep elongation being more effectively within 20 minutes.

Figure 2:
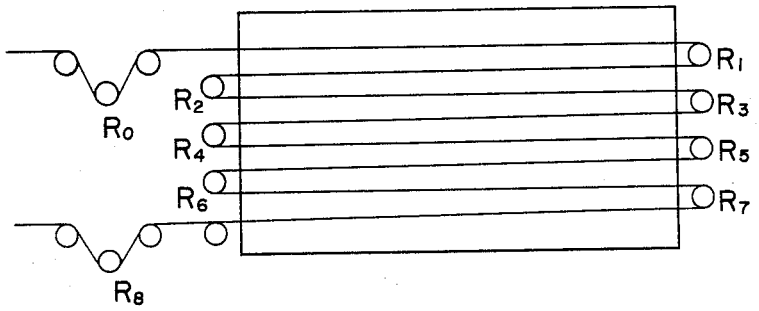
FIG. 2 is a graph illustrating an example of a fire-resisting treatment furnace used in practicing the present invention.
Figure 3:
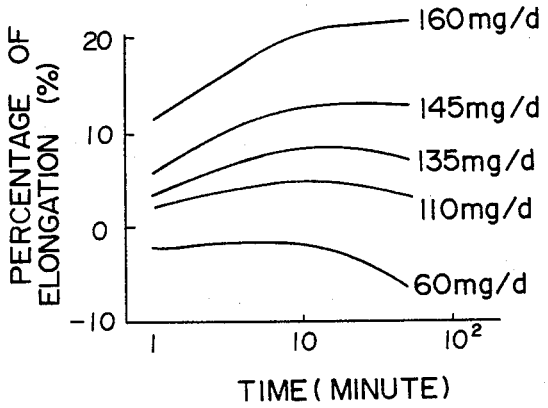
FIG. 3 is a graph showing the elongation or shrinkage of an acrylic fiber in the air at 240° C. under varied loads. The numbers on the abscissa indicate the time and those on the ordinate the percentage of elongation. The denier (indicated as "d" in the Figure) refers to that of the precursor.

An example of the flame-resisting treatment furnace provided with a plural number of driving rolls used in this invention is illustrated in FIG. 2. FIG. 3 shows an example of elongation or shrinkage behavior with lapse of time of a starting acrylic fiber in the air at 240° C. under various constant loads.

The process according to this invention will be concretely described below.

The acrylonitrile copolymers used in this invention are those which contain 80% by mole or more of acrylonitrile monomer units. Preferred are copolymers with a comonomer containing a functional group which can promote oxidation, crosslinking and the cyclization of nitrile groups in the flame-resisting treatment. Examples of such comonomers include hydroxyl-group containing monomers such as 2-hydroxyethyl methacrylate and 1,2-hydroxyethylacrylonitrile; carboxyl-group containing monomers such as acrylic acid, methacrylic acid and itaconic acid; and monomers containing a nitrogen atom of tertiary amines or quaternary ammonium salts such as dimethylaminoethyl methacrylate. The comonomers may be used either alone or as a mixture thereof. There can be used neutral monomers such as methyl acrylate, methyl methacrylate, styrene, acrylamide, methacrylamide, vinyl acetate, vinyl chloride, vinyl bromide and vinylidene chloride; acidic monomers such as allylsulfonic acid, styrenesulfonic acid and methallylsulfonic acid; and basic monomers such as vinylpyridine. An acrylonitrile content of the copolymer of less than 80% by mole is unfavorable because then the tendency of adhesion or fusion-bonding of the fiber in the flame-resisting treatment increases and the application of tension in said treatment is difficult, which makes it impossible to obtain a high-performance carbon fiber and greatly lowers the carbonization yield.

Usable methods of spinning include wet spinning, dry spinning, dry-wet spinning and melt spinning. Usually, wet spinning or dry- wet-spinning is preferably used.

There is no particular limitation as to the solvent used in the spinning so long as it is an organic solvent capable of dissolving the acrylonitrile-type copolymer such as dimethylformamide, dimethylacetamide and dimethyl sulfoxide or a solvent capable of solvating to the nitrile group. The preparation of spinning dope and the spinning operation can be conducted in the same manner as in the production of conventional acrylic fibers. Since fibers of a fine size of 0.5 to 3 deniers are required as the acrylonitrile-type fiber precursor for carbon fibers, it is preferable to wet-spin the spinning dope into a coagulation bath of a mixture of water with the organic solvent used in preparing the dope by using a nozzle having a pore diameter of 0.06 to 0.08 mm. It is preferable to stretch the coagulated gel fiber in the air or to adopt such stretching operations as stretching in multi-stage coagulation baths in order to enable a stretching operation of high draw ratio of the spun fiber. The coagulated gel fiber thus obtained is generally washed with hot water, stretched, treated with textile oils, and dried to increase its density in the same manner as in conventional methods of producing acrylic fibers. In the above process, the stretching is conducted under stretching conditions of a higher draw ratio than in usual fibers for clothing, and the treatment with textile oils is conducted in such a way that a required minimum amount of oil is attached to the fiber which oil is the same as that used in fibers for clothing or which will suit to the object of the polyacrylonitrile-type fiber as the precursor for carbon fibers. It is important that the oil is uniformly attached to the fiber without causing uneven sticking. Conventional method of attaching is sufficient for attaining the purpose. The bundle of fibers having the oil attached thereto is dried and made to increase its density on a roll of preferably 110° to 140° C. under tension or while allowing some elongation or shrinkage, giving thus uniform fibers free from voids.

The precursor thus obtained is then treated in such a way that the amount of aminosiloxane represented by the following formula attached thereto will be 0.01 to 0.5% by weight:

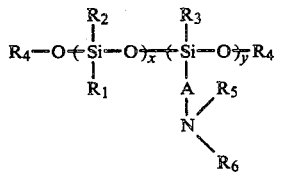

wherein $R_1$ is a hydrogen atom, a lower alkyl group or an aryl group;

$R_2$ and $R_3$ are each a lower alkyl group or an aryl group;

$R_4$ is a hydrogen atom, a lower alkyl group, or

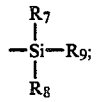

$R_7$ and $R_8$ are each a lower alkyl group;

$R_9$ is a hydrogen atom or a lower alkyl group;

$R_5$ and $R_6$ are each a hydrogen atom, a lower alkyl group or an aminoalkyl group;

A is an alkylene or arylene group; and x and y are positive integers which together make the molecular weight of the aminosiloxane not more than 100,000 and the nitrogen content 3 to 10% by weight.

When the amount of aminosiloxane oil attached to the fiber in the above process step is less than 0.01% by weight relative to the weight of fiber, it is difficult to attach the oil uniformly on the surface of the fiber, to collect properly the fibers into tow in the flame-resisting treatment step, and to apply the flame-resisting treatment uniformly to each of the fibers constituting the tow, which results in forming adhesion-bonded or fusion-bonded fibers and makes the production of high-quality and high-performance carbon fibers impossible. On the other hand, precursors having an excessive amount of attached aminosiloxane oil are unfavorable since the reaction in the flame-resisting treatment becomes not uniform and fusion-bonded parts are formed. Most preferably, the oil is attached to the fiber so as to give uniform oil film on the fiber surface.

The acrylic fiber precursor prepared as mentioned above is then once wound around a bobbin and stored. When the precursor thus wound is drawn out of the bobbin, it does not always show a satisfactory separation of fibers. Particularly when an aminosiloxane-type oil has been used, the precursor is required to show good fiber-separation before entering the flame-resisting treatment furnace.

In the present invention, accordingly, the precursor which has been prepared, dried and made dense as mentioned above is unwound from the bobbin and treated under tension in cold or hot water at a constant length or at a draw ratio of not more than 1.8. The fiber separation is markedly improved by the treatment, particularly by a hot-water treatment at a draw ratio of 1.1 to 1.8.

The precursor thus prepared shows good fiber-separation in the flame-resisting treatment. This enables, together with the effect of uniform attaching of the oil to the fiber surface, uniform flame-resisting treatment of both the inside and the outside of the tow. Consequently, adhesion- or fusion-bonded parts are not formed in the tow during the flame-resisting treatment and carbon fibers of extremely high quality and high performance can be produced.

When the precursor subjected to the treatment for attaching aminosiloxane oil thereto is further subjected to a dry-heat treatment, for example, to 1.1- to 3-fold stretching at 150° to 350° C., carbon fibers of still higher performance can be obtained.

The method of flame-resisting treatment used in this invention will be described below.

An example of the flame-resisting treatment furnace provided with a plural number of driving rolls used in this invention is illustrated in FIG. 2. FIG. 3 shows an example of elongation or shrinkage behavior with lapse of time of a starting acrylic fiber in the air at 240° C. under various constant loads.

Figure 4:
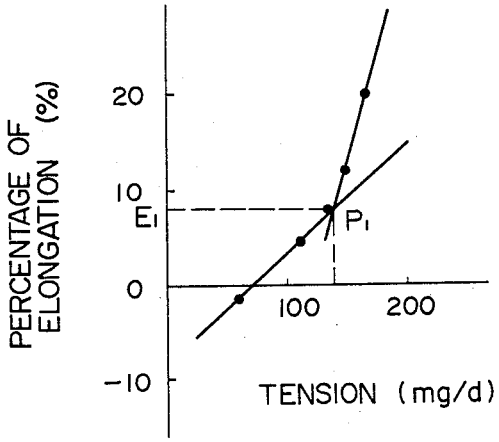
FIG. 4 is a graph obtained by plotting the percentage of elongation or shrinkage at a time point of 10 minutes in FIG. 3 against respective loads.

In FIG. 2, it is assumed that the residence time of the fiber in the furnace from the roll $R_0$ to the roll $R_1$ is 10 minutes and the temperature of atmosphere is 240° C. Then, from FIG. 3, the percentage of elongation or shrinkage at the same period of 10 minutes and the corresponding load are read off and plotted to give a graph formed of two straight lines having approximately an inflection point $P_n$ as shown in FIG. 4. Usually, however, fibers treated in the flame-resisting treatment furnace in the heat-treatment step and those treated in a batch furnace are different from each other in the dependency of changes of fiber properties on temperature and time because of the difference of equipment characteristics even when treated in atmospheres of the same temperature.

Accordingly, sometimes better results can be obtained by operating at a same value of a physical property parameter, particularly at a same fiber density which is a measure showing the degree of progress of the flame-resisting treatment, than operating at a same residential time in the furnace as mentioned above. Thus, the percentage of elongation $E_1$ corresponding to the inflection point $P_1$ is determined. Determination by wide-angle X-ray diffraction reveals that the degree of orientation increases with the increase of elongation up to the percentage of elongation $E_1$ but tends to level off thereafter. There is also observed development of fluff in the region. Thus, the percentage of elongation $E_1$ represents the optimum percentage of elongation between rolls $R_0$ and $R_1$.

Figure 5:
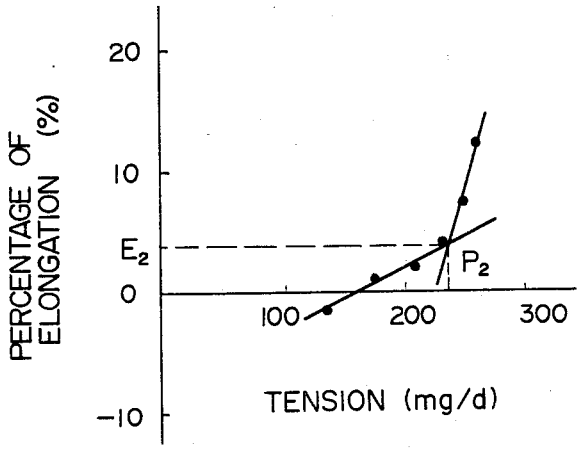
FIG. 5 is a plot obtained for a fiber at the feed-side roll $R_1$ in a similar manner to that in FIG. 4.

Then, the percentage of elongation to be applied between rolls $R_1$ and $R_2$ will be determined. In this case, batchwise experiments similar to those mentioned before are conducted by using the fiber at the feed-side roll $R_1$, namely the fiber which has been applied an elongation $E_1$ by treatment at 240° C. for 10 minutes, and the relation between loads and percentages of elongation is plotted as shown in FIG. 5, from which the percentage of elongation $E_2$ is then determined.

Hereafter, the percentages of elongation between respective rolls are determined in the same manner. The percentage of elongation $E_n$ (n being an integer larger than zero) thus determined, namely the optimum percentage of elongation, may sometimes, depending on the nature of acrylic fibers, present itself in the shrinkage side. The residence time of the fiber between respective rolls is preferably not more than 20 minutes, more preferably 2 to 15 minutes. When the time is longer than 20 minutes, the length of elongation region increases and the percentage of elongation between the rolls also increases correspondingly, resulting in uneven elongation. Moreover, since the difference of tension from that in the next roll interval increases, slipping occurs at the boundary roll and the frequency of fluff development increases. When the time is less than 2 minutes, the number of times of contact of fiber with rolls increases, which also causes development of fluff. Further, a very large number of rolls become necessary, which is very disadvantageous from the point of necessary equipment.

The method of carbonization used in this invention will be described below.

The density of the fiber after the flame-resisting treatment is required to be in the range of 1.26 to 1.38 g/cm$^3$. Fibers having a density of less than 1.26 g/cm$^3$ after the treatment are insufficient in the degree of flame-resisting treatment, will undergo frequent fiber breakage in the carbonization treatment conducted later in an inert atmosphere, and thus cannot give carbon fibers of good performance. On the other hand, fibers subjected to flame-resisting treatment to have a too large density exceeding 1.38 g/cm$^3$ cannot be given a sufficient elongation, which is required for producing high-performance carbon fibers, in the low-temperature carbonization conducted in an inert atmosphere at 300° to 800° C.; when such elongation is forcibly applied to the fibers there appear such phenomena as frequent development of fluff and breakage of fibers.

Figure 1:
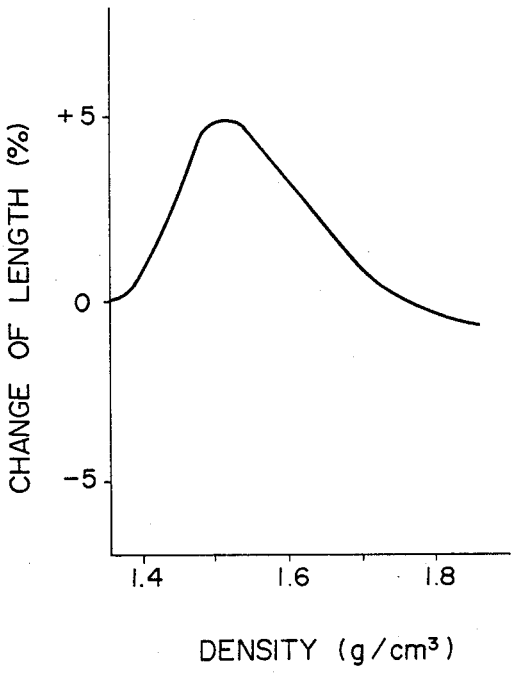
FIG. 1 is a graph showing the change of length of a flame-resisting-treated fiber when the fiber is continuously heat-treated at increasing temperatures. The change of fiber length is plotted as the ordinate and the fiber density is plotted as the abscissa.

In the first step and the second step of precarbonization in an inert atmosphere of the flame-resisting-treated fibers, the most marked change in fiber structure occurs as shown in FIG. 1. Accordingly, if the treatment of the fibers in these heat-treatment steps is not properly conducted, it makes the production of high-performance carbon fibers impossible and further leads to development of fiber defects such as fiber breakage. This invention has succeeded in producing a high-performance carbon fiber while preventing the occurrence of troubles mentioned above by subjecting in an inert atmosphere the flame-resisting-treated fiber to a heat-treatment at the first precarbonization step under application of tension to attain a fiber density of not less than 1.40 g/cm$^3$ and less than 1.57 g/cm$^3$ and then to another heat treatment at the second precarbonization step under application of tension to attain a fiber density of not less than 1.57 g/cm$^3$ and not more than 1.75 g/cm$^3$.

The tension applied during the treatment of the first step of precarbonization means a tension under which the fiber undergoes an elongation of 3 to 30%, preferably 5 to 20%, in the heat-treatment step. When the percentage of elongation in the elongation step is too small, carbon fibers of high performance, particularly of high tenacity, can hardly be produced. On the other hand, too large percentage of elongation tends to cause troubles such as breakage of fibers. Further, carbon fibers of more excellent uniformity can be obtained by controlling the percentage of elongation in the heat-treatment step in detail by using several nip rolls.

The tension applied during the treatment of the second step of precarbonization means a tension under which the fiber undergoes an elongation of 1 to 20% in the heat-treatment step. When the fiber is heat-treated under a tension which will cause shrinkage of the fiber length in the heat-treatment step, it can hardly give a carbon fiber of high performance. On the other hand, when the percentage of elongation is too high, there occur troubles such as breakage of fibers.

The heat-treatment temperature in the heat-treatment step is preferably in the range of 250° to 800° C. More preferably, the temperature of the treatment in the first step of precarbonization is selected in the range of 250° to 600° C. and that in the second step of pre-carbonization is selected in the range of 400° to 800° C.

As mentioned above, when a flame-resisting-treated fiber is treated under a specified tension to attain a specified fiber density, the resulting fiber has no defect and has an enhanced degree of orientation as compared with heat-treated fibers hitherto developed. Resultantly, the fiber can fully maintain the structure even at the carbonization step conducted later in an inert atmosphere at a temperature not lower than 800° C., particularly at 1,000° to 3,000° C., and can thus constantly give a uniform carbon fiber of high performance.

According to the process of this invention, the flame-resisting-treated fiber having characteristics described above is first subjected to the precarbonization by heat-treating it in an inert atmosphere at increasing temperatures in the range of 300° to 800° C. In said heat treatment, the rate of temperature increase from 350° C. up to 450° C. is required to be maintained at 10° to 100° C./minute. Although the intended carbon fiber may be prepared by using a rate of temperature increase of less than 10° C./minute, such a low rate is unfavorable because it greatly lengthens the residence time of the fiber in the temperature region and markedly increases the energy cost required for obtaining carbon fibers. On the other hand, when the rate of temperature increase is raised over 100° C./minute, the flame-resisting-treated fiber having a low density undergoes a rapid thermal decomposition which can lead to a violent reaction, and thus cannot give the intended carbon fiber. The flame-resisting-treated fiber having a density of 1.26 to 1.38 g/cm$^3$ used in this invention can be elongated up to 30% without development of fluff in the fiber when treated in an inert gas atmosphere, whereby the molecular orientation in the fiber can be greatly improved. Further, by maintaining the rate of temperature increase within the above-mentioned range, the thermal decomposition of the flame-resisting-treated fibers can greatly be decreased and carbon fibers can be obtained in a high carbonization yield.

From the consideration of energy cost, the rate of temperature rise of the flame-resisting-treated fiber in an inert atmosphere up to 350° C. and that from 450° C. to 800° C. are preferably made as high as possible so long as the fiber undergoes no objectionable phenomenon such as breakage. For example, carbonization treatment is preferably conducted such that the temperature increases at a rate of 100° to 1000° C./minute up to 350° C. and at a rate of 300° to 5000° C./minute from 450° C. to 800° C.

EXAMPLE

This invention will be described in more detail below with reference to Examples.

Strand tenacity and strand modulus of elasticity were determined according to the method defined in JIS R 7601.

EXAMPLE 1

An acrylic fiber having a composition of 98% by weight of acrylonitrile, 1% by weight of methyl acrylate, and 1% by weight of methacrylic acid (total denier: 4,360; 3,000 filaments; single fiber tenacity: 5.0 g/d; elongation: 13.0%) was subjected to a heat treatment in a flame-resisting treatment furnace of hot-air circulation type having a temperature profile of three steps of 220°-240°-260° C. In the treatment, driving rolls were provided at respective boundaries between the first zone, the second zone, and the third zone of the flame-resisting treatment and, based on the residence time of the fiber between respective driving rolls, namely in each zone, of 20 minute, the percentages of elongation $E_1$, $E_2$ and $E_3$ were determined according to the procedure of this invention by using a batch furnace. As the result, the percentages of elongation in the first, the second and the third zone were 15.0±1.0% or less, 5.2±0.6%, and 0.0±1.2%, respectively. After subjected to the flame-resisting treatment under above-mentioned conditions, the resulting treated fiber having a density of 1.35 g/cm$^3$ was passed through the first carbonization furnace of 600° C. in nitrogen stream for 3 minutes, during which an elongation of 5% was applied to the fiber, and the fiber was further heat-treated under a tension of 400 mg/denier in the second carbonization furnace of 1200° C. in the same atmosphere. The strand tenacity and the strand modulus of elasticity of the carbon fiber obtained are shown in Table 1.

EXAMPLE 2

In the same flame-resisting treatment furnace as used in Example 1, the free rolls positioned in respective centers between respective driving rolls were replaced with driving rolls to make the residence time of the fiber between respective driving rolls 10 minutes. The percentages of elongation $E_1$, $E_2$ through $E_6$ were determined in the same manner as mentioned above and found to be 12.0 ±1.2%, 5.4 ±0.6%, 3.4 ±0.9%, 2.0 ±1.0%, 0.8 ±1.0% and −0.8 ±0.8%, respectively. A carbon fiber was prepared under the same conditions as in Example 1 except for the above-mentioned elongation conditions in the flame-resisting treatment. The properties of the fiber obtained are shown in Table 1.

COMPARATIVE EXAMPLE 1

A carbon fiber was obtained in the same manner as in Example 1 except that the percentages of elongation $E_1$, $E_2$ and $E_3$ were made 10.0%, 2.0% and 0%, respectively. The properties of the fiber obtained are shown in Table 1.

COMPARATIVE EXAMPLE 2

A carbon fiber was obtained in the same manner as in Example 1 except that all of the driving rolls in the flame-resisting step were replaced with free rolls and an elongation of 20% was applied to the fiber only by means of godet rolls positioned at the inlet and the outlet of the flame-resisting treatment furnace. The properties of the fiber obtained are shown in Table 1.

TABLE 1

| | Percentage of elongation in flame-resisting treatment (%) | Tenacity (kg/mm$^2$) | Modulus of elasticity (ton/mm$^2$) |
|---|---|---|---|
| Example 1 | 15.0/5.2/0 | 503 | 25.0 |
| Example 2 | 12.0/5.4/3.4/2.0/0.8/−0.8 | 538 | 25.8 |
| Comparative Example 1 | 10/2.0/0 | 448 | 24.4 |
| Comparative Example 2 | 20 | 412 | 24.6 |

EXAMPLE 3

Carbonization was conducted by using the flame-resisting-treated fiber obtained in Example 1.

Table 2 shows the conditions for treatment at each step and the results of property evaluation of the carbon fibers obtained. The temperature of atmosphere and the treatment time at the first step of precarbonization were 350° to 500° C. and 3 minutes, respectively, and those at the second step of precarbonization were 500° to 800° C. and 3 minutes, respectively. The carbonization was conducted in nitrogen atmosphere at 1200° C.

TABLE 2

| | 1st precarbonization step | | 2nd precarbonization step | | | |
|---|---|---|---|---|---|---|
| Experiment No. | Density (g/cm$^3$) | Percentage of elongation (%) | Density (g/cm$^3$) | Percentage of elongation (%) | Tenacity (kg/mm$^2$) | Modulus of elasticity (t/mm$^2$) |
| 1 | 1.445 | 8 | 1.602 | 4 | 531 | 25.9 |
| 2 | 1.495 | 8 | 1.735 | 4 | 529 | 26.2 |
| Comparative experiment | | | 1.561 | 12 | 495 | 25.0 |

EXAMPLE 4

Flame-resisting-treated fibers having respectively a density of 1.28, 1.32 and 1.385 g/cm$^3$ were prepared in the same manner as in Example 1 but by altering the temperature in the third zone of the flame-resisting treatment. The resulting fibers were then subjected to carbonization.

Table 3 shows the conditions for treatments and the results of property evaluation of the carbon fibers obtained. Carbonization was conducted under nitrogen atmosphere in three steps, namely low temperature carbonization at 350° to 450° C., precarbonization at 450° to 800° C., and carbonization at 800° to 1300° C.

TABLE 3

| Experiment No. | Density of flame-resisting-treated fiber (g/cm$^3$) | Rate of temp. increase between 350 and 450° C. (°C./min) | Percentage of elongation in low temp. carbonization (%) | Tenacity (kg/mm$^2$) | Modulus of elasticity (t/mm$^2$) | Yield (%) | State of fiber |
|---|---|---|---|---|---|---|---|
| 1 (Comparative) | 1.32 | 50 | 2 | 380 | 24 | 54 | |
| 2 | " | " | 15 | 510 | 26 | 54 | |
| 3 | " | " | 25 | 515 | 27 | 54 | |
| 4 | " | 100 | 15 | 485 | 25.5 | 53 | |
| 5 (Comparative) | " | 50 | 32 | — | — | — | Breakage |
| 6 (Comparative) | " | 200 | 15 | 450 | 25 | 52 | Fluff |
| 7 | 1.28 | 50 | 15 | 495 | 25 | 52 | |
| 8 (Comparative) | 1.385 | " | 15 | 400 | 26 | 56 | Fluff |

EXAMPLE 5

A polymer prepared by aqueous suspension polymerization having a composition of 98% by weight of acrylonitrile and 2% by weight of methacrylic acid and a specific viscosity of 0.18 (determined with a solution of 0.1 g of polymer in 100 ml of dimethylformamide at 25° C.) was dissolved in dimethylformamide to form a dope having a concentration of 24% by weight.

The dope was then spun through a spinning nozzle having hole diameter of 0.15 mm and number of holes of 2,000 by dry-wet method, then washed and stretched to obtain a water-swollen acrylic fiber having a water content of 120%.

Then, an aminosiloxane represented by the formula

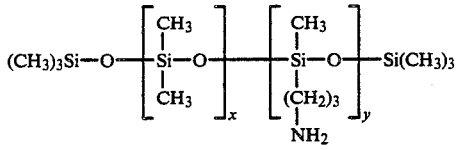

was attached by impregnation to the water-swollen fiber obtained above. Succeedingly the fiber was subjected to drying and density-increasing treatment to prepare an acrylic fiber of 1.3 denier. The quantitative determination of silicon in the fiber revealed that the amount of aminosiloxane attached by impregnation was 0.6% by weight based on the weight of the fiber.

In the preparation of said acrylic fiber, the washing temperature was varied as shown in Table 4. Neither stretching in washing nor dry-hot stretching was applied to the fiber.

These fibers were then subjected to heat treatment. In the heat treatment, the flame-resisting treatment and the carbonization were respectively conducted under the same conditions as those in Example 1 and those in Example 4.

The rate of temperature increase between 350° C. and 450° C. in the carbonization was 80° C./min.

The results of the heat treatments are shown in Table 4.

TABLE 4

| Experiment No. | Temperature of washing treatment (°C.) | Strand tenacity (kg/mm²) | State of fusion-bonding between fibers |
|---|---|---|---|
| Comparative experiment | No treatment | 400 | Marked fusion-bonding |
| 1 | 20 | 501 | No fusion-bonding |
| 2 | 50 | 533 | " |
| 3 | 90 | 523 | " |

The state of fusion-bonding between fibers was judged as follows: a carbon fiber strand was stretched until break at a specimen length of 10 cm and a stretching velocity of 2 mm/min. The results were evaluated as "no fusion-bonding between fibers" when the tenacity was 7 g/d or more, "partial fusion-bonding" when it was not less than 5 g/d and less than 7 g/d, and "marked fusion-bonding" when it was less than 5 g/d.

EFFECT OF THE INVENTION

According to the process of this invention, the flame-resisting-treated fiber can be stretched under a sufficiently high tension at the low-temperature carbonization step and resultantly can give a highly oriented fiber, so that a high-performance fiber with little variation of quality having a tenacity of at least 400 kg/mm² and a modulus of elasticity of at least 25 ton/mm² can be produced constantly and stably.

Further, according to the present invention, the thermal decomposition of the flame-resisting-treated fiber at the low-temperature carbonization step can be greatly suppressed. Thus, this invention can provide a process for producing carbon fibers with a high carbonization yield and hence can contribute greatly to reducing the production cost.

What is claimed is:

1. A process for producing a carbon fiber which comprises subjecting a polyacrylonitrile-type polymer fiber to a flame-resisting treatment in a flame-resisting treatment furnace provided with a plural number of driving rolls in an oxidizing atmosphere at 200° to 400° C. under application of multistep elongation, during said treatment the respective percentage of elongation in each step the elongation being set respectively at a value which is equal to or within ±3% of the value of the precentage of elongation, En, indicating an inflection point, Pn, obtainable from a plot of the percentage of elongation versus the load, and then subjecting the treated fiber to carbonization.

2. A process for producing a carbon fiber according to claim 1, wherein the fiber subjected to the flame-resisting treatment has a density of 1.26 to 1.38 g/cm³.

3. A process for producing a carbon fiber according to claim 1, wherein the fiber subjected to the flame-resisting treatment is subjected to a heat treatment in an inert atmosphere under tension to attain a density of not less than 1.40 g/cm³ and less than 1.57 g/cm³, then to another heat treatment in an inert atmosphere under tension to attain a density of 1.57 to 1.75 g/cm³, and further to a heat treatment in an inert atmosphere at a temperature not lower than 800° C.

4. A process for producing a carbon fiber according to claim 1, wherein the fiber subjected to the flame-resisting treatment is subjected in an inert atmosphere to a heat treatment at 300° to 800° C. and then to a heat treatment at a temperature not lower than 1000° C., in said former heat treatment the rate of temperature increase between 350° C. and 450° C. being within the range of 10° to 100° C./minute and an elongation not less than 3% and not more than 30% being applied to the fiber, in the temperature range of 350° to 450° C.

5. A process for producing a carbon fiber according to claim 1, wherein a polyacrylonitrile-type polymer fiber is subjected to a flame-resisting treatment which fiber has been prepared by spinning an acrylonitrile copolymer containing 80% by mole or more of acrylonitrile monomer unit to form an acrylic fiber precursor, then attaching to the precursor an aminosiloxane-type oil by impregnation so as to give a content of the oil of 0.01 to 0.5% by weight based on the weight of the fiber, and subjecting the resulting precursor to a washing treatment in cold or hot water at constant fiber length or while stretching the precursor at a draw ratio of not more than 1.8.

6. A process for producing a carbon fiber according to claim 1, wherein the residence time of the fiber between respective driving rolls in the multistep elongation is not more than 20 minutes.

* * * * *